US006088967A

United States Patent [19]

Johnson

[11] Patent Number: 6,088,967

[45] Date of Patent: Jul. 18, 2000

[54] CLOSING STRING LIGHT DISPLAY BOX

[76] Inventor: Wayne A Johnson, 2303 Winchester St., Oceanside, Calif. 92054

[21] Appl. No.: 09/002,440

[22] Filed: Jan. 2, 1998

[51] Int. Cl.[7] ..... F21V 21/00; E04F 19/00

[52] U.S. Cl. ..... 52/28; 52/732.2; 362/145; 362/219; 362/225; 362/249

[58] Field of Search ..... 248/49, 65; 52/220.7, 52/28, 290, 287.1, 288.1, 732.1, 732.2; 362/151, 152, 219, 225, 249, 391

[56] References Cited

U.S. PATENT DOCUMENTS

| | | | |
|---|---|---|---|
| 3,374,590 | 3/1968 | Kessler | 52/464 |
| 3,540,687 | 11/1970 | Cuva | 362/249 |
| 3,692,993 | 9/1972 | Robinson | 362/249 |
| 4,391,426 | 7/1983 | Göthberg | 248/49 |
| 4,852,832 | 8/1989 | Delaney | 362/249 |
| 5,031,083 | 7/1991 | Claesson | 362/249 |
| 5,067,061 | 11/1991 | Prickett | 362/145 |
| 5,311,414 | 5/1994 | Branham, Sr. | 362/249 |
| 5,404,279 | 4/1995 | Wood | 362/145 |
| 5,510,966 | 4/1996 | Konecny | 362/249 |
| 5,594,628 | 1/1997 | Reuter et al. | 362/249 |
| 5,598,681 | 2/1997 | DiGianni | 52/288.1 |
| 5,813,751 | 9/1998 | Shaffer | 362/249 |

FOREIGN PATENT DOCUMENTS

| | | | |
|---|---|---|---|
| 629078 | 9/1949 | United Kingdom | 52/732.2 |

*Primary Examiner*—Michael Safavi
*Attorney, Agent, or Firm*—Wayne A. Johnson

[57] ABSTRACT

A string light display box having a box shaped cross section for supporting string or tube bulb lighting in a predetermined place on a structure. The display box has a top wall, a bottom wall and a rear wall to enclose a plurality of light bulbs such as along a decorative string lighting. The rear wall has a wire keeper attached thereto with said wire keeper formed of two parallel extrusions extending perpendicularly from a back wall of the wire keeper. The parallel extrusions extending longitudinally along the display box forming a wire channel for accommodating wiring of the string lighting. The keeper having a slight ridge on an inner edge making the opening of the keeper narrower than the wire channel formed by the parallel extrusions to hold the wire of the string lighting in place. The wire keeper may be removably mountable upon a rear wall by way of a catch and a keeper slide with each said rear wall catch and said keeper slide extending from the rear wall of the display box. A circular notch being cut at intervals along each of the parallel extrusions so as to allow for placement of bulbs extending along the string lighting. A front cover conceals the parallel extrusions with the cover being removably attachable to the display box top and bottom walls by way of securing means in the form of at least one front cover catch engageable with at least one corresponding wall keeper.

1 Claim, 6 Drawing Sheets

CLOSING STRING LIGHT DISPLAY BOX

BACKGROUND

1. Field of Invention

This invention relates to displaying and storing string lighting, such as Christmas or other holiday lighting.

2. Description of Prior Art

This invention relates to holding string lighting, specifically those used for holiday decorations.

Around the holidays people commonly decorate with string lighting such as Christmas lights. Attaching these lights is done with staples, nails, screws, and such things which can do damage to the structure they are being secured to, or the wire of the lighting itself. If the wire gets damaged it can cause a fire due to wires shorting together.

The lighting is usually installed and removed every holiday. This can be time consuming to accomplish and causes undue breakage and wire damage.

OBJECTS AND ADVANTAGES

Accordingly, several objects and advantages of my invention are:

(a) to provide a semi permanently attached box to the structure that need not be removed to help prevent structure damage;

(b) to provide a box to hold the string lighting wire, or wires, without damage to the wire;

(c) to provide a box that can be opened to present your light display;

(d) to provide a box that can be closed to protect and store your string lighting when not being used;

(e) to provide a box to save the time and inconvenience of set up and take down of your light display.

Further objects and advantages would be to provide a box that is easy to mount, which can be opened or closed in a short period of time to either display or conceal your display, which lights could easily be installed into the box, and eliminates the need for storage of the string lights when not currently on display. Due to the design of the box, when closed, would look like molding or trim. Still further objects and advantages will become apparent from a consideration of the drawings and ensuing description.

DRAWING FIGURES

In the drawings the same parts have the same figure numbers with different alphabetical suffixes to show different views.

REFERENCE NUMBERS IN DRAWINGS

| | |
|---|---|
| 10 | rear base |
| 12 | wire channel |
| 13 | bulb channel |
| 14 | wire keeper |
| 16 | rear wall |
| 17 | bottom wall |
| 18 | top wall |
| 20 | top drip edge |
| 22 | front cover |
| 23 | front wall |
| 24 | bottom drip edge |
| 26 | front cover catch |
| 28 | top wall keeper |
| 30 | bottom wall catch |
| 32 | bottom wall keeper |
| 34 | rear wall hinge |
| 36 | front wall hinge |
| 38 | center hinge |
| 40 | alternate wire keeper assembly track |
| 42 | alternate wire keeper assembly |
| 48 | rear wall slide |
| 46 | rear wall catch |
| 50 | wire keeper, keeper |
| 52 | removable wire keeper |

SUMMARY

In essence a light box comprises a rear base, having a slot for wire storage with keepers to hold it in, and a cover to protect and store display lighting when not in use.

DESCRIPTIONS

FIGS. 1 to 8

Figure 1A:
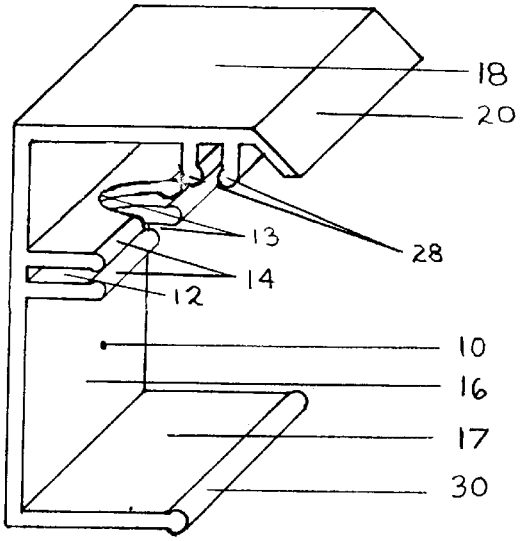
FIGS. 1A to 1C show various aspects of the light box with a removable cover, drip edges, wire channel, optional bulb channel and wire keeper.
Figure 1B:
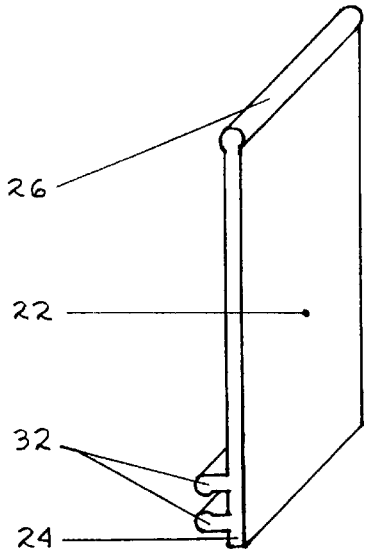
Figure 1C:
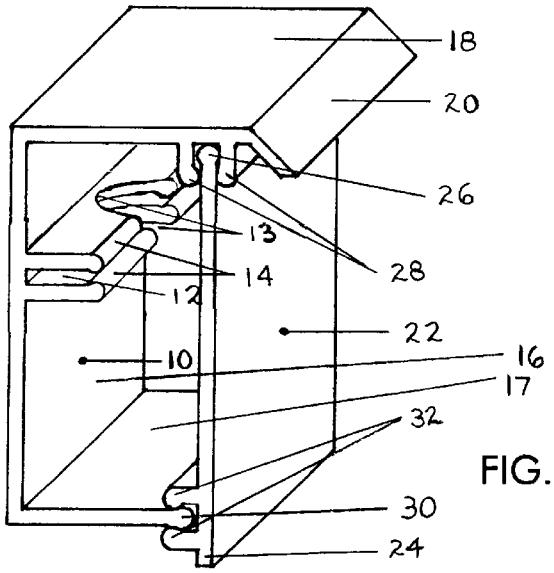

A typical embodiment of the light box is illustrated in FIG. 1A (rear base, side view), FIG. 1B (front cover, side view), and FIG. 1C (rear base and cover together, side view). The light box consists of the rear base 10, and the front cover 22 approximately 2¾ inches by approximately 1¾ inches and approximately five to ten foot in length and is of a material that resists heat and freezing temperatures without breaking or catching fire, under normal use. This material can be plastic, fiberglass, or any other such material having these characteristics.

A rear base 10, consists of a rear wall 16, a top wall 18, a top drip edge 20, top wall keeper 28, a bottom wall 17, a bottom wall catch 30, wire keeper 14, leaving a wire channel 12.

A front cover 22, consists of a front cover catch 26, a bottom wall keeper 32, and a bottom drip edge 24.

The leading and trailing edges of the wire keeper 14, top wall keeper 28, bottom wall keeper 32, front cover catch 26, and bottom wall catch 30, are typically rounded to make it possible to:

(a) install and remove lighting wire into and out of wire channel 12, passing through wire keeper 14.

(b) install and remove front cover catch 26, into and out of top wall keeper 28.

(c) install and remove bottom wall catch 30, into and out of bottom wall keeper 32.

Figure 2A:
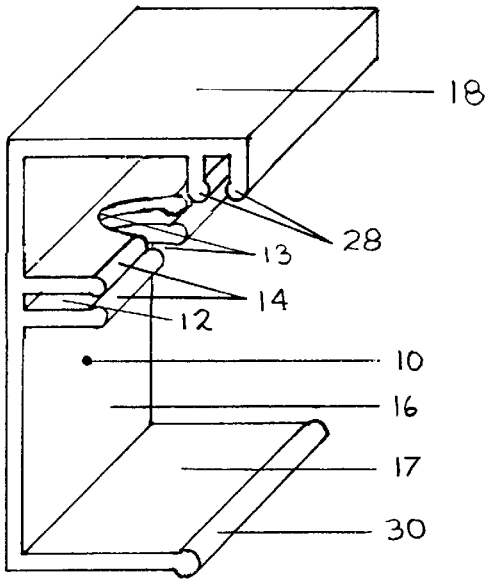
FIGS. 2A to 2C show above mentioned light box with no drip edges.
Figure 2B:
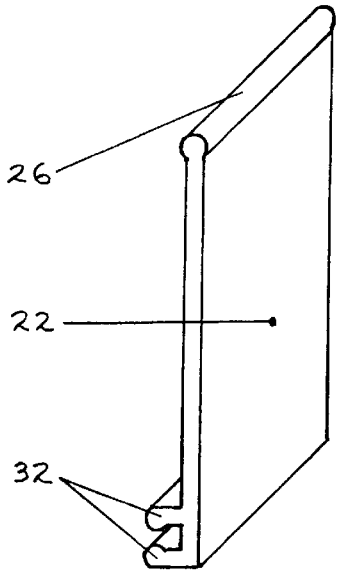
Figure 2C:
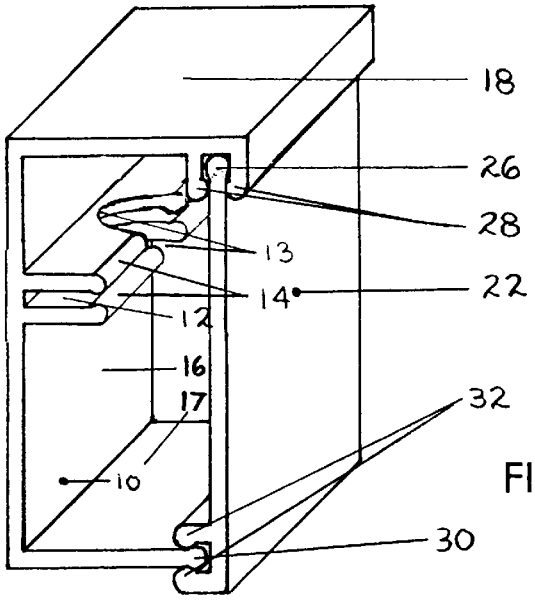
Figure 3A:
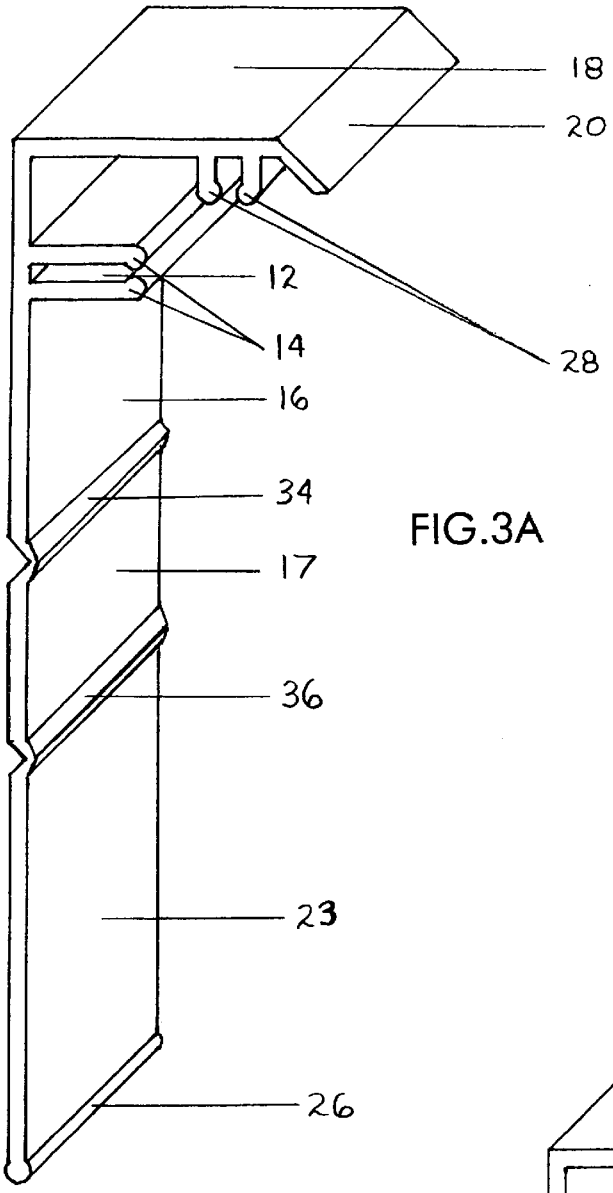
FIGS. 3A and 3B shows a similar light box to that of FIG. 1, hinged in two places, without a removable cover with 3B showing optional bulb channel.
Figure 3B:
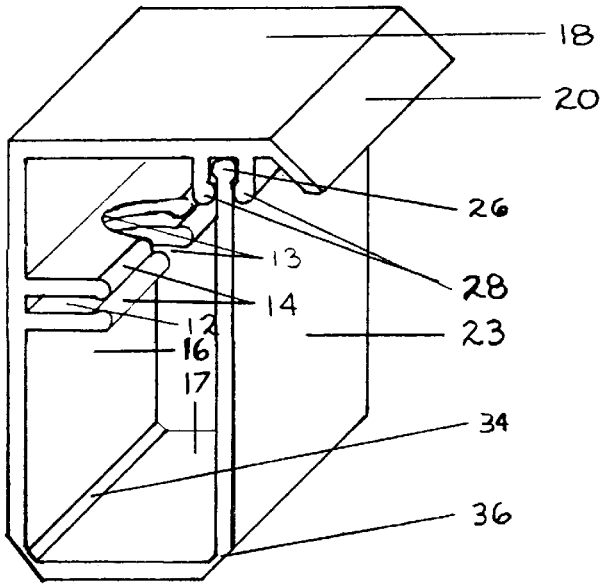
Figure 4A:
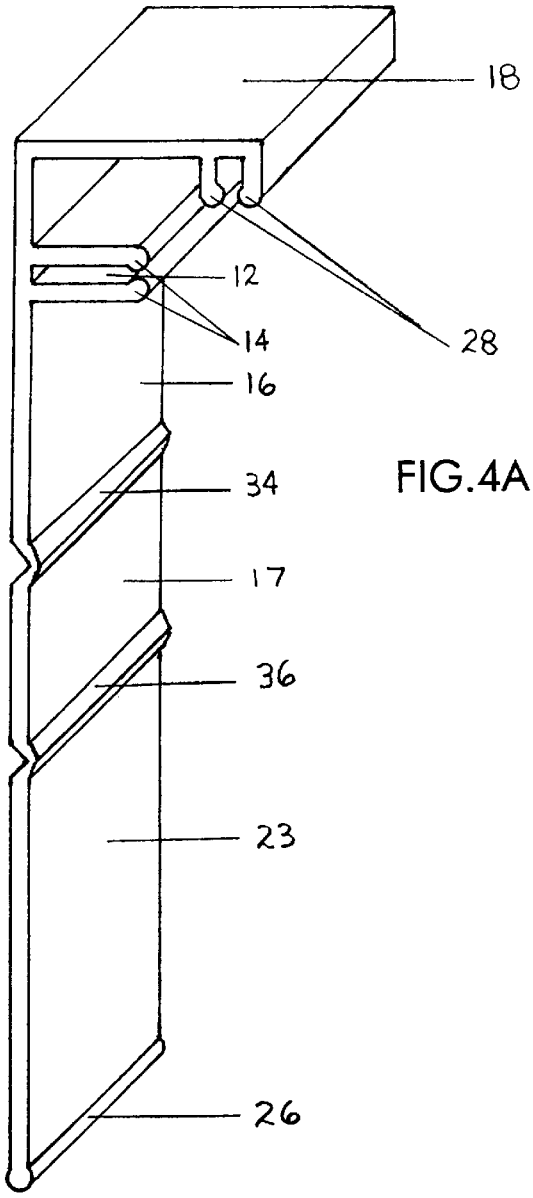
FIGS. 4A and 4B shows a similar light box to that of FIG. 3, with no drip edge with 4B showing optional bulb channel.
Figure 4B:
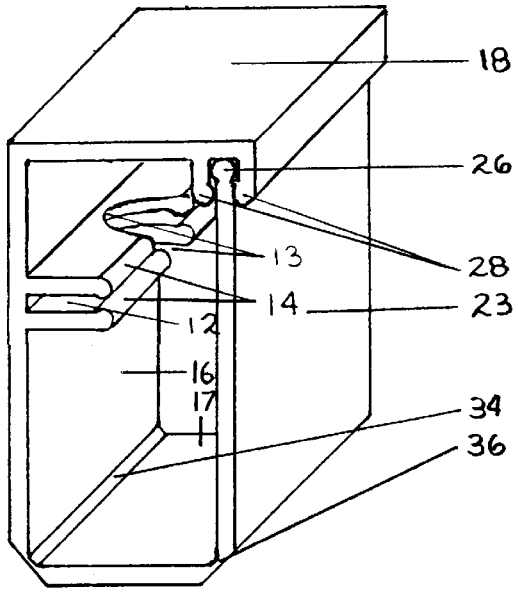

The light box is snapped apart and together using the above mentioned keepers and catches to either display or store string lighting Another embodiment is shown in FIG. 2 which is identical to that of FIG. 1 without the drip edges 20 and 24.

Figure 5A:
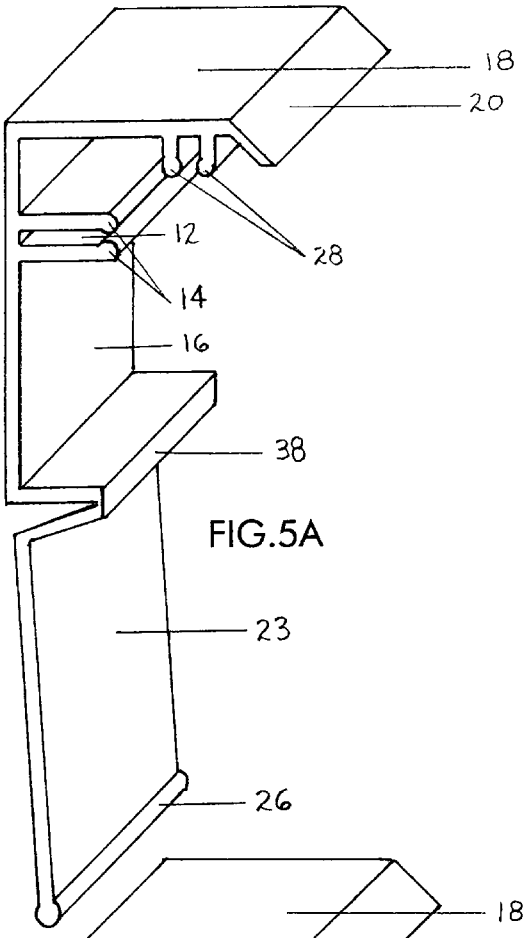
FIGS. 5A and 5B shows a similar light box to that of FIG. 3, hinged in only one place, without a removable cover with 5B showing optional bulb channel.
Figure 6A:
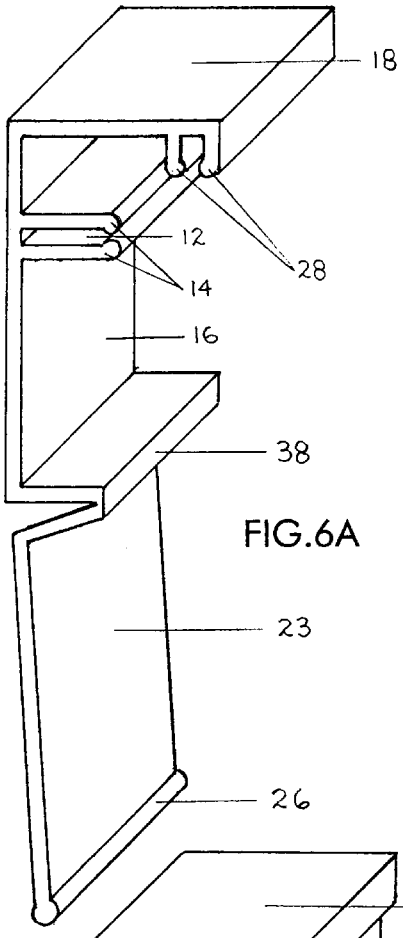
FIGS. 6A and 6B shows the similar light box to that of FIG. 5, with no drip edge with 6B showing optional bulb channel.
Figure 5B:
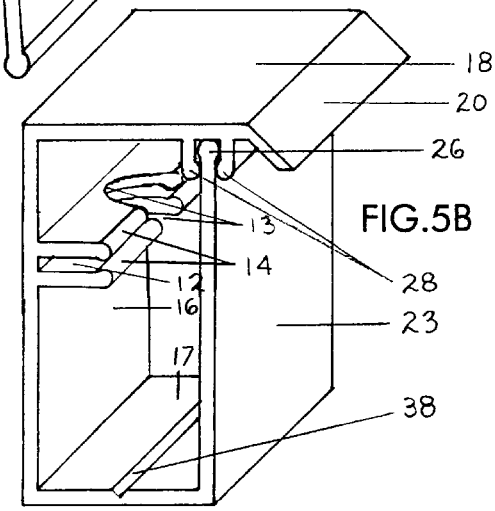
Figure 6B:
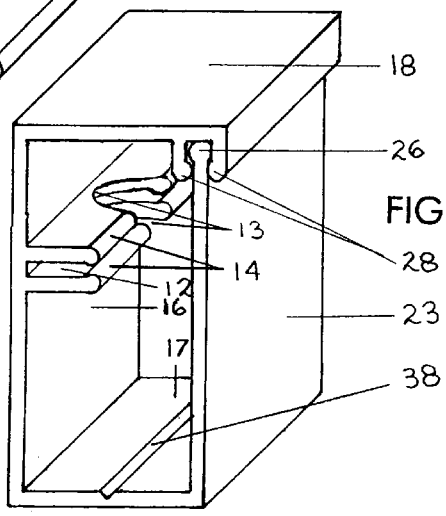

Additional embodiments are shown in FIGS. 3, 4, 5, and 6. In each case they are shown with non-removable front wall 23, by the use of rear wall hinge 34, and front wall hinge 36, in (FIG. 3 and FIG. 4), and the use of the center hinge 38 in (FIG. 5 and FIG. 6).

Figure 7A:
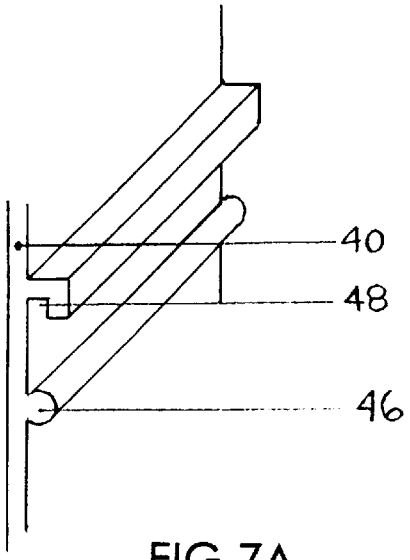
FIGS. 7A to 7C show an alternate rear wall design that has a wire track and supports removable wire keepers with 7C showing removable wire keeper with optional bulb channel.
Figure 7B:
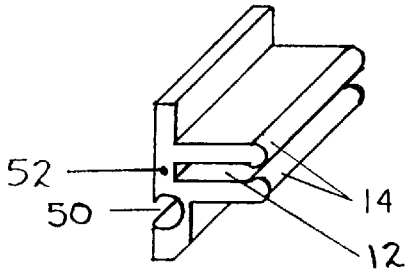
Figure 7C:
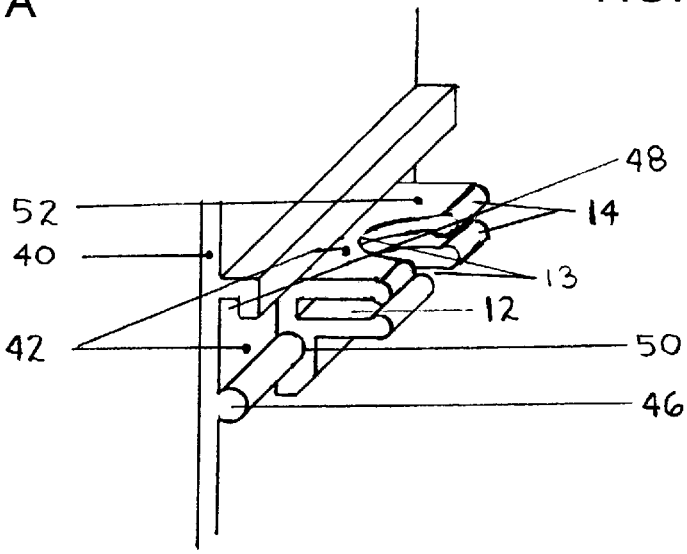

Further additional embodiments are shown in FIG. 7, with alternate wire keeper assembly track 40, and alternate wire keeper assembly 42, which consists of a rear wall slide 48, a rear wall catch 46, and wire keeper 50. These alternate parts allow the removal and replacement of alternate wire keeper assembly 42, to any location on alternate wire keeper assembly track 40.

Figure 8:
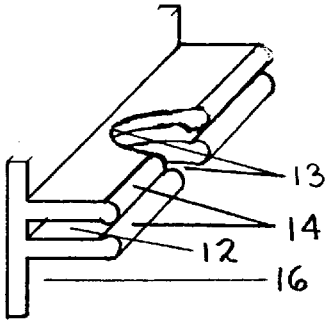
FIG. 8 shows a cut away view of the rear wall, wire channel, wire keeper with optional bulb channel.

Last additional embodiment shown is in FIG. 8. It shows a bulb channel 13, which can be created on any of the previously mentioned embodiments.

There are various possibilities with regards to removable covers, and drip edges as shown in FIGS. 2, 3, 4, 5, and 6 as well as the alternate wire keeper assembly track and alternate wire keeper assembly as shown in FIG. 7 and bulb channel in FIG. 8.

OPERATION

FIGS. 1 and 2

The manner of using the light box is as follows:

(a) Attach the light box rear base 10, to the area you want to display the string lights, (b) lay the string lights out and remove the kinks and tangles, (c) start with the plug end of the string lights, and push the wire through the wire keeper 14, into the wire channel 12, and place the light bulb into the bulb channel 13, until all the wire is in the wire channel 12, and all the bulbs are in the bulb channel 13, (d) plug the string lights into an outlet.

To close up the light box when the display is not being used simply proceed as follows:

(a) unplug the string lights, (b) push the front cover catch 26, into the top wall keeper 28, at a slight angle, (approx. 5 degrees), to give clearance to the bottom wall catch 30. Keep pushing until it snaps together, (c) push the front cover 22, towards the rear base 10, and keep pushing until the bottom wall catch 30, and bottom wall keeper 28, snap together, To open a closed light box you should:

(a) pull out on the bottom portion of the front cover 22, until the bottom wall catch 30, and the bottom wall keeper 32 unsnap, then (b) pull down until the front cover catch 26, and the top wall keeper 28 unsnap, (c) store cover until it is time to close the display.

OPERATION

FIGS. 3, 4, 5, and 6

The manner of use in these other embodiments FIGS. 3 to 6 are very similar, the only difference will be opening and closing the display as follows:

To open a light box;

(a) pull down on the front wall 23, of the light box until the front cover catch 26, and top wall keeper 28 unsnap, (b) lower the center hinge 38 (FIG. 5 and 6), or front wall hinge 36, and rear wall hinge 34 (FIGS. 3 and 4), until the front wall 23 is hanging down and the lights are displayed.

To close a light box;

(a) fold the center hinge 38 (FIG. 5 and 6), or the front wall hinge 36, and rear wall hinge 34 (FIGS. 3 and 4), until the front cover catch 26, and the top wall keeper 28 are aligned, (b) push up front wall 23 until front cover catch 26 and top wall keeper 28 snap together.

OPERATION

FIG. 7

The manner of use for this alternate embodiment is for giving a means to do custom lighting displays in which the bulb channel 13 (FIG. 8), is not in proper placement and use is as follows:

(a) To set up take removable wire keeper 52 and place the top end of wire keeper into rear wall slide 48

(b) press removable wire keeper 52 in until rear wall catch 46 and wire keeper 50 snap together (c) wire is installed in this removable wire keeper 52, the same as in Operation FIGS. 1 & 2(*c*)

SUMMARY, RAMIFICATIONS, AND SCOPE

Thus a reader will see that a light box is a lightweight, easy to use, easy to install device that can be installed by almost anyone with basic tools and hardware and can be a decorative accent to a structure when not in use as it can be made to look like a piece of molding.

In addition to the ease of use and installation the cover provides additional advantages in that it keeps the wire of the lights from getting cut with staples, nails, hooks, and other mounting devices;

it eliminates set up and take down from year to year thus saving time and wear and tear on the lights;

it eliminates the need for storage of the lights and thus gives you back extra storage space;

it keeps the lights from getting tangled;

it keeps the bulbs from getting broken during handling.

Although the descriptions above contain many specifications, these should not be construed as limiting the scope of the invention but merely providing illustrations of some of the preferred embodiments of this invention. For example, it can have other shapes, a wedge, a square, etc. It can be made in different colors and have front cover designs. It may use flat hinges, piano hinges, snaps, pivots, etc. It may be made larger or smaller to accommodate different size lights.

Thus the scope of this invention should be determined by the appended claims and their legal equivalents, rather than by the examples given.

I claim:

1. A string light box having a box shaped cross section for supporting string or tube bulb lighting in a predetermined place and comprising a top wall, a bottom wall and a rear wall, the rear wall having a wire keeper attached thereto and said wire keeper formed of two parallel extrusions extending perpendicularly from a back wall of the wire keeper and longitudinally along the display box, the two parallel extrusions forming a wire channel for accommodating wiring of the string lighting, said keeper having a slight ridge on an inner edge making the opening of the keeper narrower than the wire channel formed by the parallel extrusions, said wire keeper removeably mountable upon a rear wall catch and a keeper slide with said rear wall catch and said keeper slide extending from the rear wall of the display box, a circular notch being cut at intervals along each of the parallel extrusions so as to allow for placement of bulbs extending along the string lighting, a front cover for concealing the parallel extrusions, said cover being removably attachable to the display box top and bottom walls by way of securing means in the form of at least one front cover catch engageable with at least one corresponding wall keeper.

* * * * *